US006755481B2

(12) United States Patent
Katsumoto

(10) Patent No.: US 6,755,481 B2
(45) Date of Patent: Jun. 29, 2004

(54) CUTTING BLADE AND METHOD FOR CUTTING PAVEMENT IN A CIRCLE

(75) Inventor: Isami Katsumoto, Osaka (JP)

(73) Assignee: Sanko Corporation Ltd., Hirakata (JP)

( * ) Notice: Subject to any disclaimer, the term of this patent is extended or adjusted under 35 U.S.C. 154(b) by 66 days.

(21) Appl. No.: 10/012,354

(22) Filed: Dec. 12, 2001

(65) Prior Publication Data

US 2003/0107258 A1 Jun. 12, 2003

(51) Int. Cl.[7] ..... E01C 23/09

(52) U.S. Cl. ..... 299/36.1; 299/39.3; 30/310

(58) Field of Search ..... 299/36.1, 39.1, 299/39.3; 30/310; 408/199, 214

(56) References Cited

U.S. PATENT DOCUMENTS 4,645,390 A * 2/1987 Pecha et al. ..... 408/233
5,522,646 A * 6/1996 Friedman et al. ..... 299/39.3
5,755,048 A * 5/1998 Lee ..... 37/403

FOREIGN PATENT DOCUMENTS

JP 06158612 A * 6/1994 ..... E01C/23/09

* cited by examiner

*Primary Examiner*—John Kreck
(74) *Attorney, Agent, or Firm*—Armstrong, Kratz, Quintos, Hanson & Brooks, LLP

(57) ABSTRACT

A method for cutting pavement of an asphalt road or a concrete road in a circle for installation of a manhole, by using a cutting blade which has a pavement cutting edge serves as a tip for cutting the pavement and side edges serve as an inclined cutting surface to bore an inside of the pavement cut by the pavement cutting edge, thereby cutting the pavement in a frusto-conical shape.

5 Claims, 20 Drawing Sheets

Prior Art

Prior Art

CUTTING BLADE AND METHOD FOR CUTTING PAVEMENT IN A CIRCLE

BACKGROUND OF THE INVENTION

FIELD OF THE INVENTION

The present invention relates to a cutting blade and method used for a pavement cutting apparatus that cuts pavement of an asphalt road or a concrete road in a circle for installation of a manhole or the like.

In the case of manhole installation on pavement, a pavement cutting apparatus for cutting pavement in a circle (hereafter called a cutting apparatus) has so far been used to perform circular cutting of pavement at a manhole installation point. As this type of cutting apparatus, an applicant of the present invention has already proposed the apparatus shown in FIG. 15.

The apparatus shown in FIG. 15 can rotate around an axis 50*a* of a main driving shaft and can simultaneously move up and down along the axis 50*a*. An end of a radially projecting arm 51 is fixed to the lower end of the main driving shaft 50. A cutting blade 52 is fixed to another end of said arm 51. Associated with rotation of the main driving shaft 50 arranged vertically with respect to pavement R in such a way that the axis 50*a* of the main driving shaft 50 points a center P of a pavement circular-cut section Ra, a cutting blade 52 travels along the circumference of a cut circle C and simultaneously goes downward as the main driving shaft 50 lowers, thereby cutting the pavement in a circle.

When an edge of the cutting blade 52 cuts gradually the pavement R and penetrates the back of the pavement, the pavement circular-cut section Ra is cut off from the pavement R as shown in FIG. 16. A manhole is installed in the circular hole left in the pavement R after the section Ra is taken out of the pavement R.

However, conventional cutting apparatuses have a problem that the pavement circular-cut section R is hardly taken out of the pavement R. This is because the pavement circular-cut section Ra cut from the pavement R moves to a ground G due to its own weight as shown by dashed dotted line in FIG. 16 and falls below a pavement surface, and is thereby difficult to be taken out. In particular, when the ground G under the pavement R is softer, the pavement circular-cut section Ra falls more deeply so that it is extremely difficult to be taken out.

It is an object of the present invention to overcome the aforementioned problem by providing a cutting blade and method used for a pavement cutting apparatus that cuts pavement in a circle so that a circular-cut section cut off from the pavement can be easily taken out of the pavement.

SUMMARY OF THE INVENTION

A cutting blade for cutting pavement in a circle, connected to an end of a radially-projecting arm attached to a driving shaft arranged vertically with respect to a center of the circle, and moved downwardly and simultaneously rotated along a circumference of the circle of the pavement to be cut, wherein a cutting blade body having a pavement cutting edge at a bottom thereof is inclined to the center of the circle to be cut, the pavement cutting edge serves as a tip for cutting the pavement and side edges of the cutting blade body serve as an inclined cutting surface to bore an inside of the pavement cut by the pavement cutting edge, thereby cutting the pavement in a frusto-conical shape.

The cutting blade body is flat in shape and attached to a holder in a slanting direction with respect to the pavement, and the holder is connected with the arm.

More specifically, in the pavement cutting apparatus comprising the main driving shaft rotatable about its axis to be vertically arranged with respect to the pavement, an end of the radially projecting arm to be attached to the lower end of the main driving shaft, and the cutting blade attached to the other end of said arm to be moved along the circumference of a pavement circle to be cut in conjunction of rotation of said main driving shaft, and simultaneously moved toward the pavement by a movement drive means and, thereby cutting the pavement, the inclined cutting face is provided on said cutting blade.

In the aforementioned cutting apparatus, the cutting blade travels along the circumference and simultaneously the cutting face with its cutting edge set inward in a slanting direction goes straight ahead in the slanting direction so that the pavement cutting proceeds. Thus, a diameter of the cut circle reduces gradually from top to bottom and it is minimized at the bottom. As a result, the circularly cut section of the pavement can moves upwards but not downward because, when moving downward, it collides against a non-cut section of the pavement. That is, a cut surface of the non-cut section of the pavement supports the circularly cut section of the pavement from below so as to completely prevent the circularly cut section from falling into the ground. Thus, the circularly cut section of the pavement can be easily taken out of the pavement.

In the cutting blade, a radially-projecting stepped portion is provided with the cutting blade body above the pavement cutting edge, thereby cutting the pavement in a stepped shape above the frusto-conical shape.

Alternatively, the present invention provides a cutting blade for cutting pavement in a circle, connected to an end of a radially-projecting arm attached to a driving shaft arranged vertically with respect to a center of the circle, and moved downwardly and simultaneously rotated along a circumference of the circle of the pavement to be cut, wherein a cutting blade body having a pavement cutting edge at a bottom thereof is positioned in a direction perpendicular to the pavement and a triangled-shaped inclined cutting edge is fixed to an upper portion of the cutting blade body above the pavement cutting edge, the pavement cutting edge serves as a tip for cutting the pavement and the triangled-shaped inclined cutting edge serve as an inclined cutting surface to bore an inside of the pavement cut by the pavement cutting edge, thereby cutting the pavement in a frusto-conical shape.

On an upper portion of the triangle-shaped cutting edge, an additional stepwise-cutting face radially projecting may be provided to further cut the frusto-conical surface of the cut pavement in a step shape. In such a way, the step provided on the peripheral surface of the frusto-conically cut section of the pavement supports the cut section so as to prevent the cut section from falling down.

Furthermore, the present invention provides a method for cutting pavement of an asphalt road or a concrete road in a circle for installation of a manhole, by using a cutting blade which has a pavement cutting edge serves as a tip for cutting the pavement and side edges serve as an inclined cutting surface to bore an inside of the pavement cut by the pavement cutting edge, there by cutting the pavement in a frusto-conical shape. Particularly, said cutting blade connected to an end of a radially-projecting arm attached to a driving shaft arranged vertically with respect to a center of the circle, and moved downwardly and simultaneously rotated along a circumference of the circle of the pavement to be cut, wherein the cutting blade is inclined to the center of the circle to be cut, and cut the pavement in frusto-conical shape.

That is, the method cutting the pavement in a frusto-conical shape by using the aforementioned cutting blade for cutting the pavement.

In addition, the present invention provides a cutting blade for cutting the pavement in a circle, which comprises an cutting edge attached to the bottom of a body of said cutting blade and a radially-projecting stepwise-cutting edge fixed to an upper portion of said cutting edge, and thereby cutting the cut surface of the pavement in a stepped shape.

Further the cutting blade has a radially-protecting stepped portion above a pavement cutting edge fixed to a cutting blade body at a bottom thereof, and cut the pavement in a stepped shape above the frusto-conical shape.

For a cutting blade preferably used for the present invention, a superhard tip like a diamond one is attached to the bottom edge of the cutting blade because of its superior cutting ability and durability.

In addition, the cutting apparatus is not limited to the aforementioned one that has the cutting blade attached to the end of the arm radially projecting from the lower end of the main driving shaft. The cutting blade may be attached to a cutting apparatus for cutting the pavement, which has an annular cutting blade with a cutting edge attached to the lower end of a body of the annular cutting blade and rotates said annular cutting blade horizontally to cut the pavement, or may be attached to a cutting apparatus for cutting the pavement in a circle by rotation of a disc-shaped cutter, so as to cut the pavement in a frusto-conical shape.

Moreover, the cutting apparatus is preferably fixed to a vehicle for transportation use during operation but it is not necessary to mount the apparatus on the loading deck of the vehicle, instead it may be set up on a different pavement place near to the pavement to be cut in a circle.

DETAILED DESCRIPTION OF THE PREFERRED EMBODIMENTS

The embodiments of the present invention are described in detail below, with reference to drawings.

Figure 1:
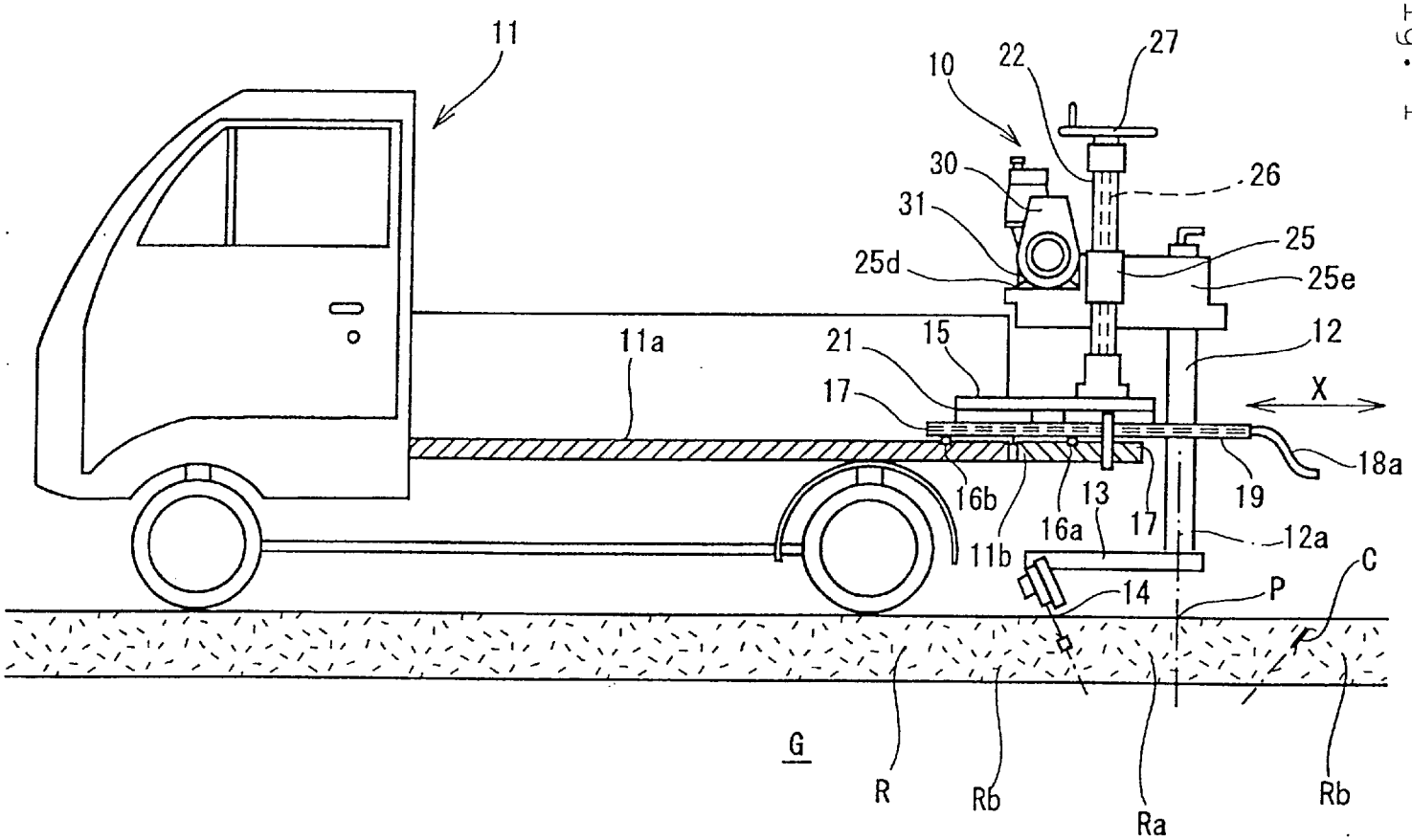
FIG. 1 is a front view showing a state of cutting work using a pavement cutting apparatus for cutting pavement in a circle of a first embodiment mounted on a vehicle.

FIG. 1 is a front view showing the entire structure of a pavement circular-cutting apparatus of a first embodiment of the present invention. A main driving shaft 12 is arranged vertically with respect to pavement R in such a manner that an axis 12*a* of the shaft 12 points a center of a section of the pavement R to be cut in a circle. The shaft 12 can rotate around its axis 12*a* by a drive means for rotation described later. An end of a radially-projecting arm 13 is attached to the lower end of the driving shaft 12 and a cutting blade 14 that is moved toward the pavement R by a movement drive means described later is attached to the other end of said arm 13. Rotating the driving shaft 12 around its axis 12*a* results in traveling of the cutting blade 14 along the circumference of a circle of the pavement R to be cut and the cutting blade 14 simultaneously is moved downward by the movement means so that the pavement R is cut in a circle.

Figure 2:
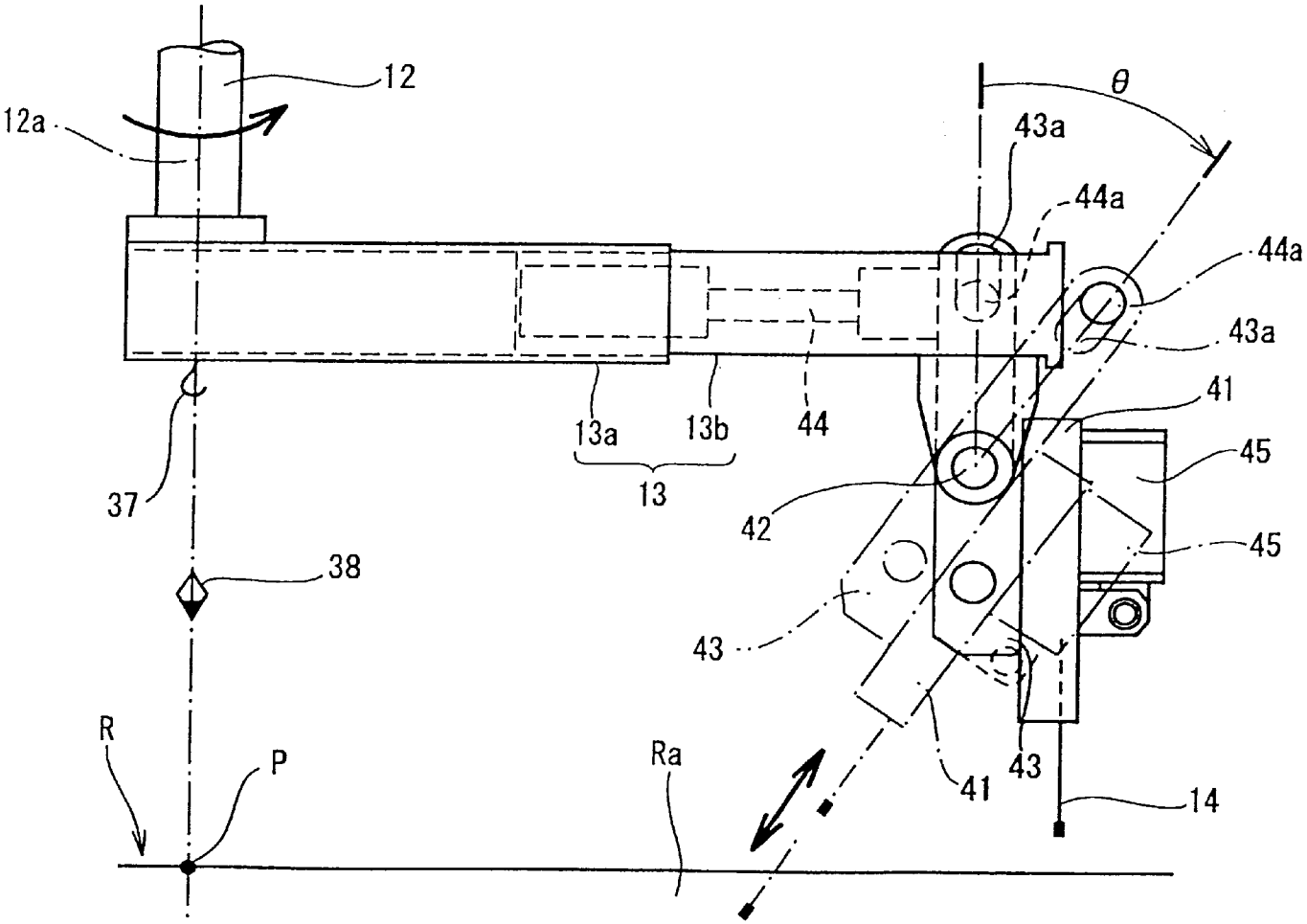
FIG. 2 is a partial front view showing a cutting blade and its vicinities of the apparatus.
Figure 3:
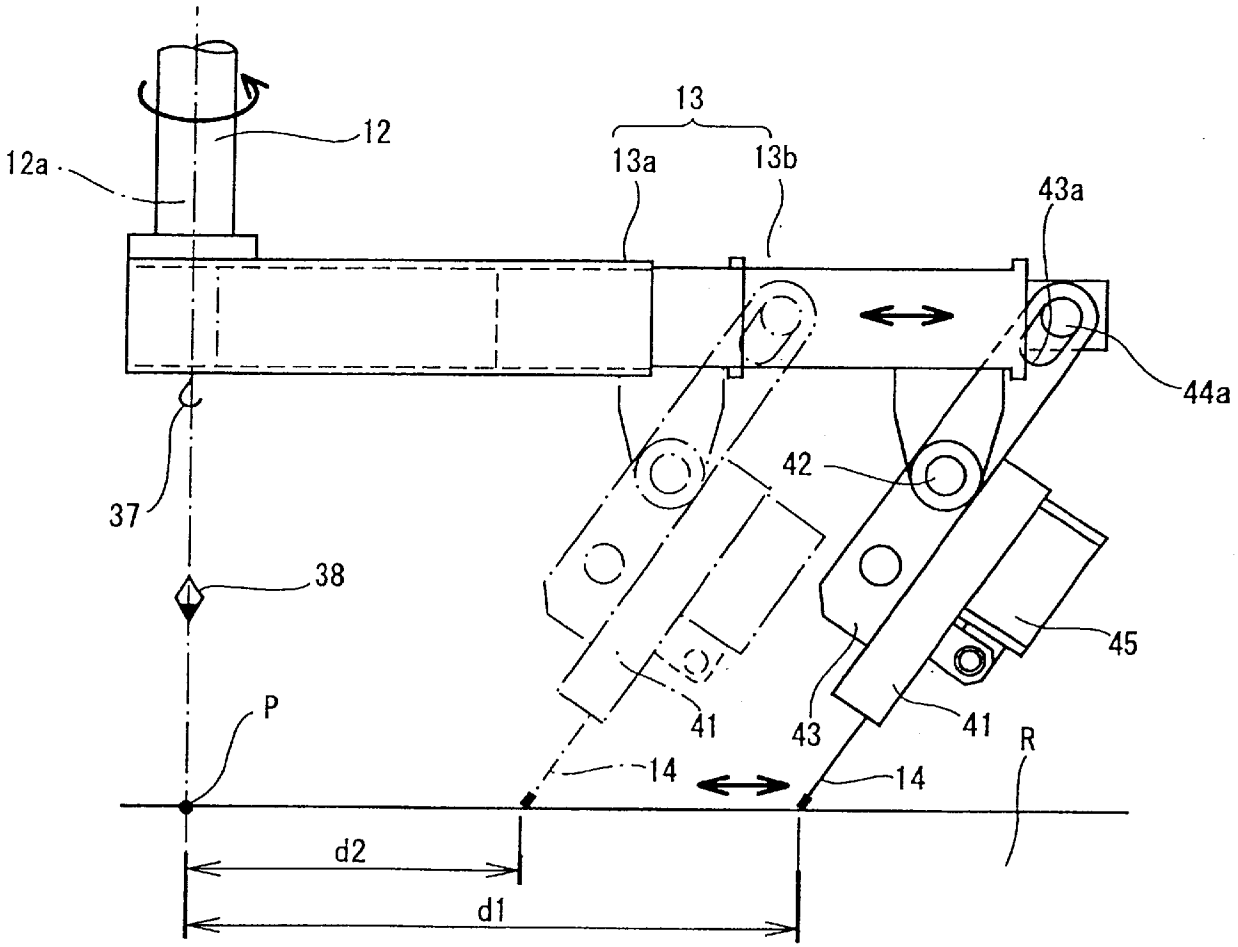
FIG. 3 is a partial front view showing an arm and its vicinities of the apparatus.

As shown in FIGS. 2 and 3, the cutting blade 14 is attached to the other end of the arm with its tip pointed inward slantly with respect to a vertical direction. Namely, while the cutting blade 14 is fixed to a holder 41, the holder 41 is attached to an inclined plate 43 in one piece. The inclined plate 43 is rotatably supported at its center by a pin 42 that is located under the other end of the arm 13 transversely and horizontally with respect to a longitudinal axis of the arm 13. As the inclined plate 43 rotates around the pin 42, the holder 41 rotates and inclines together with the plate 43. In addition, the cutting blade 14 attached to the holder 41 is arranged in such a way that its tip points inward slantly with respect to a vertical direction. Thus, a tilting angle θ of the inclined plate 43 coincides with an inward slanting degree of the cutting blade 14.

Figure 4A:
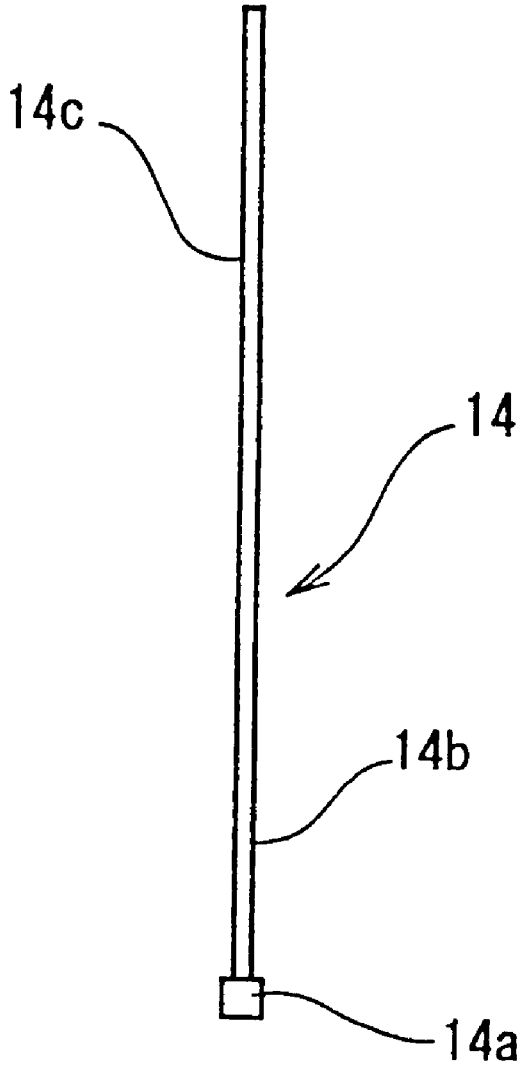
FIGS. 4(A) and 4(B) are a side view and a front view of the cutting blade of the first embodiment, respectively.
Figure 4B:
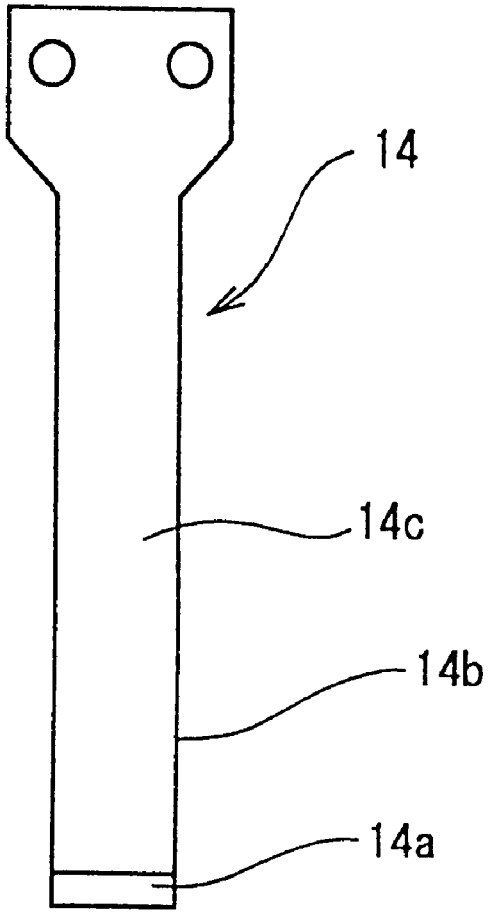

As shown in FIGS. 4(A) and 4(B), the cutting blade 14 comprises a cutting blade body 14*c* with a shape of about rectangle and a pavement cutting edge 14*a* of a diamond tip soldered on the bottom edge of the body 14*c* to achieve excellent cutting ability. Said cutting edge 14*c* serves as a tip for cutting the pavement and a side edge of the cutting blade body 14*c* serves as an inclined cutting face 14*b* to bore the inside of the pavement R cut by the cutting edge 14*a*.

Adjusting the tilting angle θ of the inclined plate 43 by a hydraulic cylinder 44 installed inside the arm 13 allows the slanting degree of the cutting blade 14 to be adjusted. Namely, a pin 44*a* slidably engages a slotted hole 43*a* provided on an upper portion of the inclined plate 43 and the pin 44*a* is moved right and left by the hydraulic cylinder 44. With the cylinder 44 operated to right, the pin 44*a* also goes to right and simultaneously upward in the slotted hole 43*a* while pushing the inclined plate 43. At the same time, the inclined plate 43 pushed by the pin 44*a* turns clockwise around the pin 42. The more the pin 44*a* travels to right, the more the tilting angle θ of the inclined plate 43 increases.

In addition, another hydraulic cylinder 45, which serves as a movement drive means to make the cutting blade 14 go straight in a slanting inward direction. As said hydraulic cylinder 45 makes the holder 41 go straight in the slanting inward direction, the cutting blade 14 is also moved in the same direction.

Furthermore, as shown in FIG. 3, the arm 13 comprises a base-side arm piece 13*a* attached to the driving shaft 12 and another arm piece 13*b* on the side for attaching the cutting blade 14. The arm piece 13*b* is fitted into the arm piece 13*a* movably in its longitudinal direction. If a diameter of the pavement to be cut changes between d1 and d2, a length of the arm 13 can be adjusted by fixing the arm piece 13*b* to the arm piece 13*a* by screws (not shown) and the like in place.

The cutting apparatus 10 provided with the cutting blade 14 is loaded on a bed 11*a* of a vehicle 11 such as, for example, a truck and transported to a working place. At the working place, a rear lid 11*b* of the vehicle 11 is opened and supported horizontally flush with the bed 11*a* so that such a horizontal flat section of said vehicle is used as a supporting base for the cutting apparatus 10.

As shown in FIG. 1, the cutting apparatus 10 in a state of mounting on the vehicle 11, is set up in such a manner that the axis 12*a* of the main driving shaft 12 points from above a center P of a circular-cut section Ra of the pavement R. The arm 13 projects from said main driving shaft 12 and the cutting blade 14 attached to the end of said arm 13 cuts the pavement R in a circle.

In addition, the cutting apparatus 10 is supported on the supporting base of the vehicle 11 through a positioning means that adjusts vertically and horizontally a position of the entire apparatus 10 in order to align the axis 12*a* of the main driving shaft 12 with the center P. A rotation drive means that drives a cutting means composed of the main driving shaft 12, arm 13, and cutting blade 14, is attached to a vertical movement drive means standing on said positioning means.

Each of the aforementioned means of the cutting apparatus 10 is described hereunder. The positioning means can move a flat-shaped supporting carriage in a forward/backward direction X (i.e. a lengthwise direction) and in a right/left direction Y (i.e. a widthwise direction) as shown in FIG. 2. That is, while fixing pins 16*a* and 16*b* are provided in the rear lid 11*b* and a rear part of the bed 11*a,* respectively, holes for inserting the fixing pins 16*a* and 16*b* are provided on a pair of lengthwise frames 17 located on the bottom of the cutting apparatus 10. The fixing pins 16*a* and 16*b* are inserted into these holes to fix the cutting apparatus 10 to the supporting base of the vehicle 11.

Figure 5:
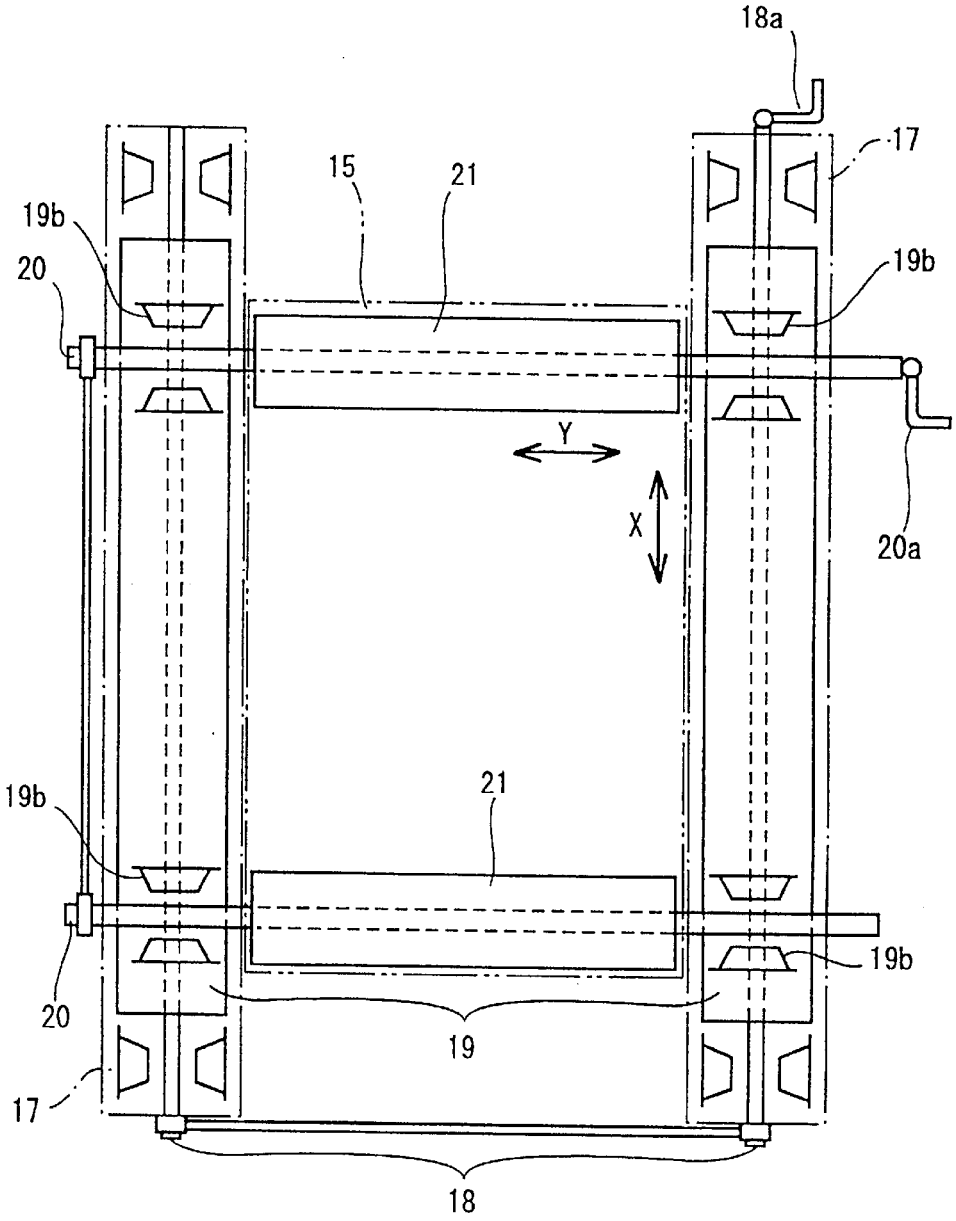
FIG. 5 is an outline plan view showing a positioning means of the apparatus.

As shown in FIG. 5, each of the lengthwise frames 17 are provided with a threaded shaft 18 through bearings and a handle 18*a* is attached to an end of one of the threaded shafts 18. Turning the handle 18*a* allows both of the threaded shafts 18 to rotate simultaneously. Said threaded shafts 18 are threadably engaged into two tapped holes provided on a lenghtwise-movable frame 19 and two sidewise threaded shafts 20 are rotatably fixed on the top surface of the lengthwise-movable frame 19 through bearings 19*b*. A handle 20*a* is attached to an end of one of said threaded shafts 20 and two sidewise frames 21 having tapped holes threadably engaging said threaded shafts 20 are provided. The sidewise frames 21 are fixed to the bottom surface of the supporting carriage 15.

Thus, by turning the handle 18*a* of the threaded shaft 18 and the handle 20*a* of the threaded shaft 20, the supporting carriage 15 can be moved lengthwise and widthwise, respectively.

Figure 6:
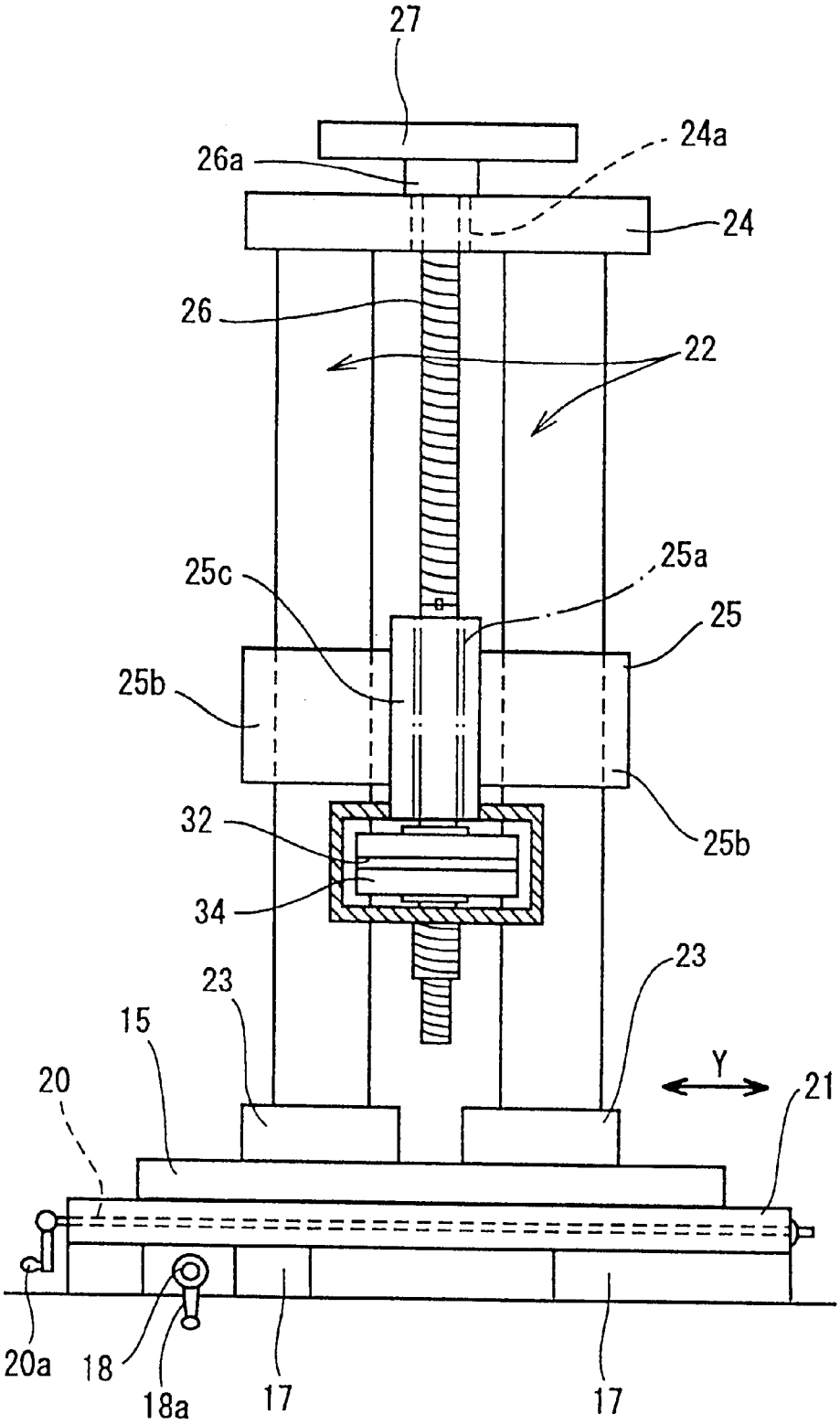
FIG. 6 is a side view of the apparatus.

A movement means for moving upwardly and downwardly the cutting blade 14 of the apparatus 10, as shown in FIG. 6, comprises two main columns 22 each of which lower end is fixed by a main bearing 23 on the top surface of the supporting carriage 15 and projects upward in parallel, a connecting plate 24 connecting the top ends of these two main columns 22 and a sleeve 25 connecting intermediate portions of the columns 22.

Tapped holes 24*a* and 25*a* are provided in the aforementioned connecting plate 24 and sleeve 25, respectively, and a lead-screw 26 passing through these tapped holes 24*a* and 25*a* is attached vertically. An upper large-diameter portion 26*a* of said lead-screw 26 is supported and rotatably fixed on a top surface of the connecting plate 24 and a handle 27 is attached to a top end of said portion 26*a*. The lead-screw 26 freely passes through the tapped hole 24 and threadably engages the tapped hole 25*a* so that the sleeve is vertically moved by turning the handle 27.

The sleeve 25 has cylinder portions 25*b* on both sides thereof and a central section 25*c* with the tapped hole 25*a* between the cylinder portions 25*b*. The columns 22 are slidably inserted in the cylinder portions 25*b* and the rotation drive means is connected to the central section 25*c*.

Figure 7:
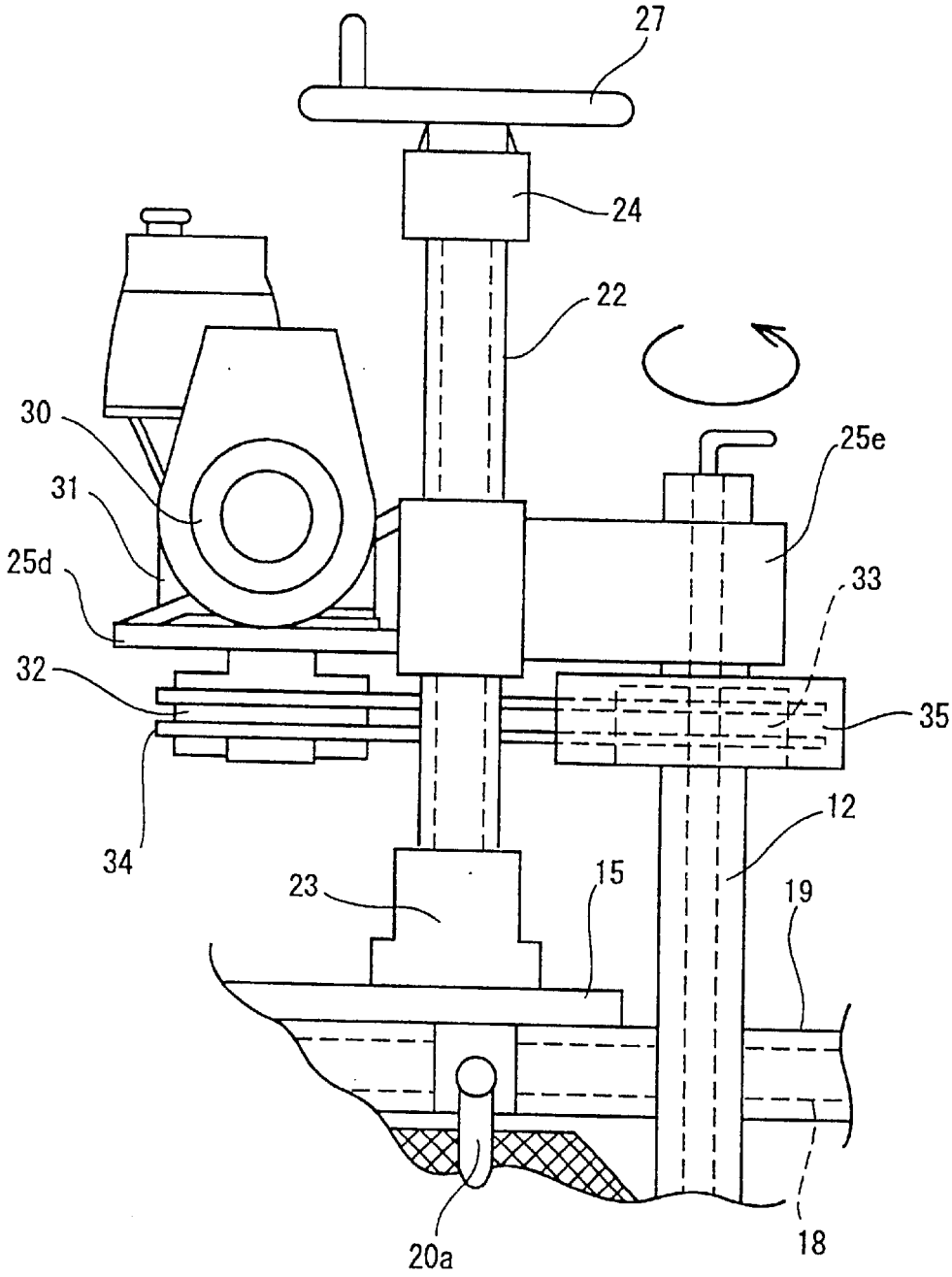
FIG. 7 is an enlarged front view showing an important part of a drive means of the apparatus.

That is, as shown in FIG. 7, while a driver-mounting frame 25*d* is projectingly provided on a front side of the central section 25*c,* a bearing section 25*e* rotatably supporting the main driving shaft 12 is projectingly provided on the rear side of a central section 25*c*.

The rotation drive means comprises a prime mover 30, a transmission gear 31 coupled to the output shaft of said prime mover 30, and a V-pulley 32 mounted on an output shaft of said transmission gear 31, and is installed on the driver-mounting frame 25*d*.

On the other hand, a top end of the main drive shaft 12 is rotatably and vertically supported in the bearing section 25*e* and a V-pulley 33 coupled to said main drive shaft 12 is arranged in line with the aforementioned V-pulley 32. A V-belt 34 connects between V-pulleys 32 and 33. In FIG. 7, the reference numeral 35 denotes a pulley cover.

When a primer mover switch (not shown) provided on a side of the driver-mounting frame 25*d* is turned on to run the prime mover 30, the main driving shaft 12 rotates in the direction of the arrow shown in FIG. 7 through the transmission gear 31 and V-belt 34.

Furthermore, a hook 37 is provided at a bottom of the arm piece 13*b* in line with the axis 12*a* and a plumb bob is suspended from the hook 37. With the aid of said plumb bob 38, the cutting apparatus 10 is adjustably moved lengthwise and widthwise by the positioning means so as to align the axis 12*a* of the main driving shaft 12 with the center P.

In addition, cooling water passages (not shown) are provided in the main driving shaft 12 and arm 13 in such a manner that cooling water impinges on the cutting blade 14 during cutting working.

Operating processes of the cutting apparatus constructed as aforementioned are described below.

Firstly, as shown in FIG. 1, the vehicle 11 is stopped near to a manhole cover 1 and then the rear lid 11*b* is opened to open a rear bed portion. The cutting apparatus 10 is fixed to the supporting face composed of the rear lid 11*b* and the rear bed portion.

A length of the arm 13 of the cutting apparatus 10 and a slant angle of the cutting blade 14 attached to the distal end of the arm 13 are set in advance. Or they may be set after the cutting apparatus 10 is fixed to the aforementioned supporting base of the vehicle 11.

In the next step, the plumb bob 38 is suspended from the hook 37 and the handles 18*a* and 20*a* of the positioning means are turned to move the support carriage 15 so as to position said plumb bob 38 directly above the center P of the pavement section to be cut in a circle. Then, the handle 27 of the lead-screw 26 for up-and-down movements is turned to lower a diamond-made tip 14*a* on the bottom of the cutting blade 14 until the tip 14*a* contacts a cut circle C of the pavement R.

Figure 8:
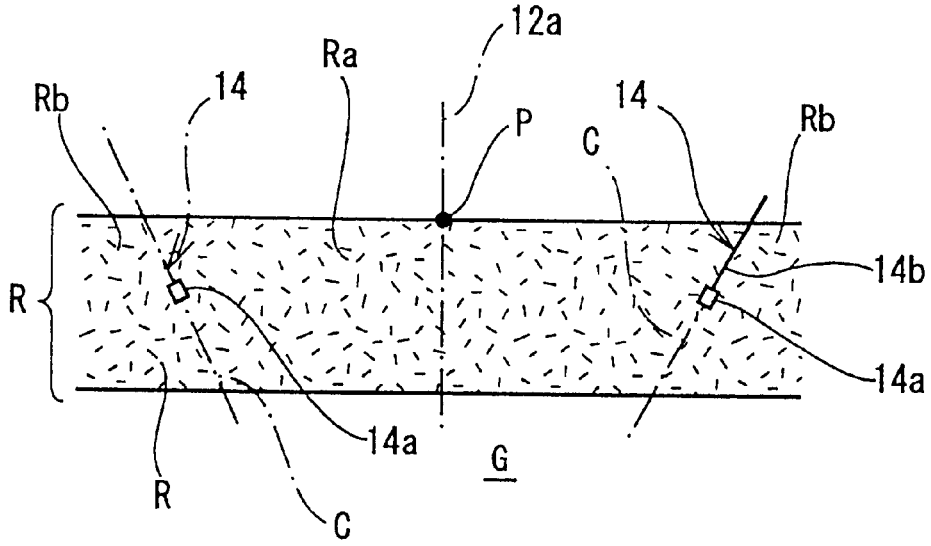
FIG. 8 is a cross-sectional view showing a state of cutting with the cutting blade.
Figure 9:
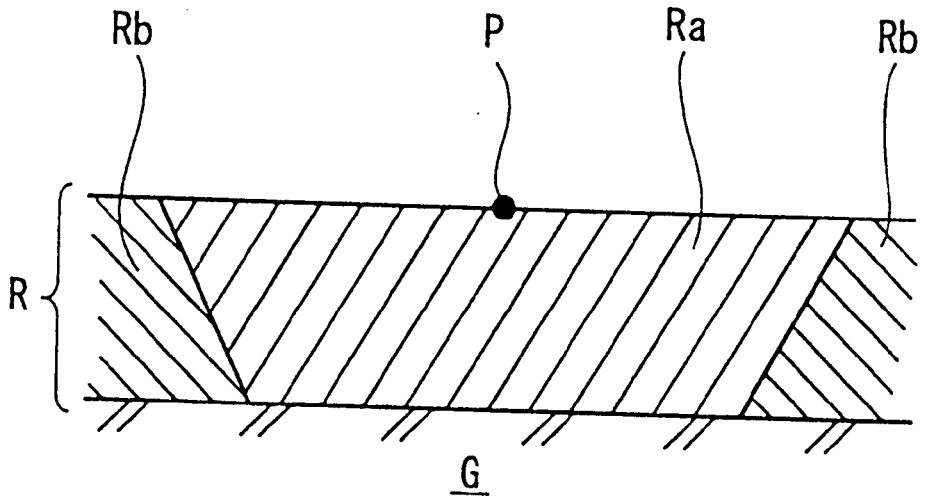
FIG. 9 is a cross-sectional view showing a cut state of pavement.

Then the prime mover 30 and transmission gear 31 are operated to rotate the main driving shaft 12 standing vertically and simultaneously operate the hydraulic cylinder 45 in such a way that the cutting blade 14 is pushed by the cylinder 45 to go straight in a slanting direction inward. As shown in FIG. 8, the cutting blade 14 travels alone the circumference with rotation of the main driving shaft 12 and simultaneously is moved downward by operation of the hydraulic cylinder 45, so that the diamond-tip cutting edge 14*a* on the bottom of the cutting blade 14 cuts the pavement in a circle. According to a desired cutting depth, the cutting blade 14 travels along the entire circumference required times to form a cut circle C having the desired cutting depth.

An inclined cutting face 14*b* of an upper portion of the cutting edge 14*a* cuts a bore of the circle cut by the cutting edge 14*a*. The diameter of the bore gradually reduces in a downward direction.

In addition, during the cutting work, cooling water supplied through the cooling water passages is jetted from the arm tip towards the cutting blade 14. This cooling water jet can reduce heat and wear of the diamond tip 14*a* and cutting blade 14.

In such a manner, the bore diameter of the cut circle C reduces gradually from top to bottom and it minimizes at the bottom. As a result, the pavement circular-cut section Ra can move upward but it cannot move downward because it is blocked by non-cut section Rb of the pavement. Therefore, the cut surface of the circular-cut section Ra is supported from below by the non-cut section Rb so as to prevent the section Ra from moving and falling down to the ground G. Thus, the circular-cut section Ra can be easily taken out.

Furthermore, in the case of the cutting apparatus of the first embodiment, the cutting blade 14 can be positioned without inclined as conventionally so as to cut vertically the pavement R in a circle.

A second embodiment is described below.

Figure 10A:
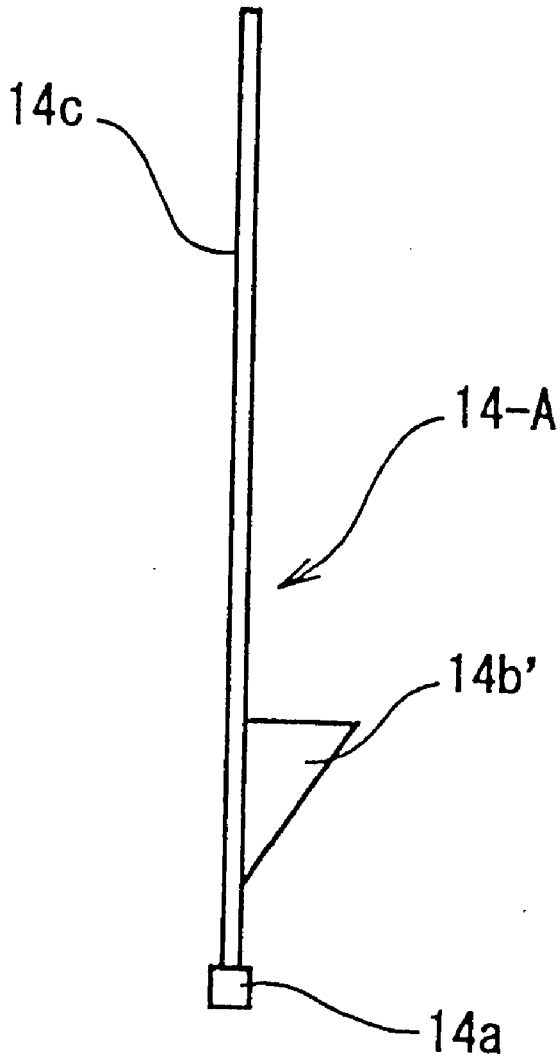
FIGS. 10(A) and 10(B) show a side view and a front view of the cutting blade of a second embodiment, respectively.
Figure 10B:
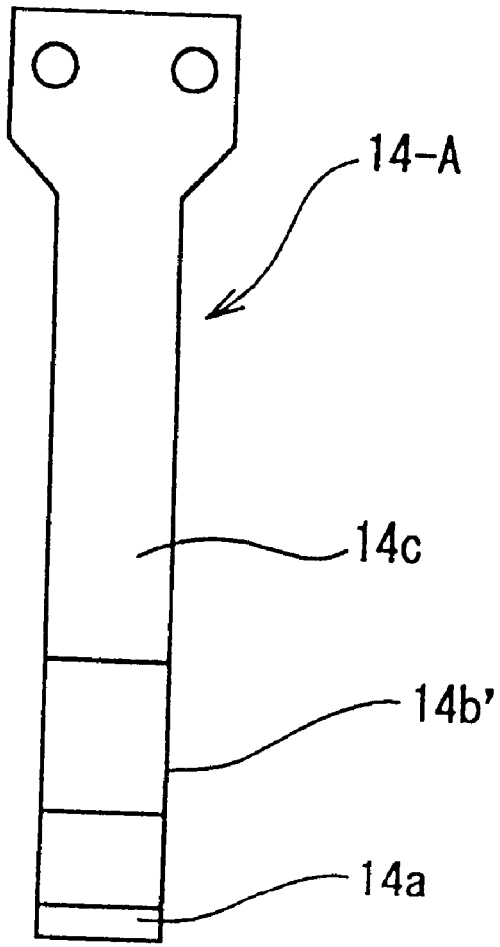

A cutting blade 14-A of the second embodiment, as shown in FIGS. 10(A) and 10(B), comprises a pavement cutting edge 14*a* fixed to the bottom of a cutting blade body 14*c* and a triangle-shaped cutting edge 14*b*′ fixed to the blade body 14*c* above the cutting edge 14*a*.

The cutting blade 14-A is positioned in a direction perpendicular to the pavement R to perform pavement cutting. During the cutting, the cutting blade 14-A is moved vertically downward by lowering the main driving shaft 12 or by operating the hydraulic cylinder 45. That is, the main driving shaft 12 and/or hydraulic cylinder 45 serve as a movement drive means for moving forward the cutting blade 14-A toward the pavement R.

In the case of cutting with the cutting blade 14-A, the cutting edge 14*b*′ also moves forward while cutting away the peripheral surface. Therefore, a space corresponding to the shape of the cutting edge 14*b*′ is formed around the pavement circular-cut section. As a result, even if the circular-cut section may move and fall to the ground, the pavement circular-cut section Ra can be easily taken out of the pavement R due to the space provided around the section Ra. In addition, the cutting edge 14*b*′ of the cutting blade 14-A has a tapered shape so that it has an excellent pavement-cutting capability and its groove formation does not interfere with the pavement cutting.

Figure 11A:
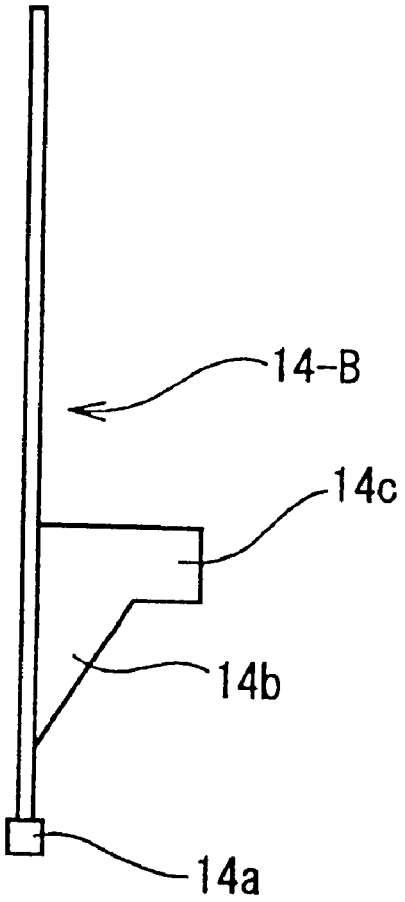
FIGS. 11(A) and 11(B) show a side view and a front view of a modified cutting blade of the second embodiment, respectively.
Figure 11B:
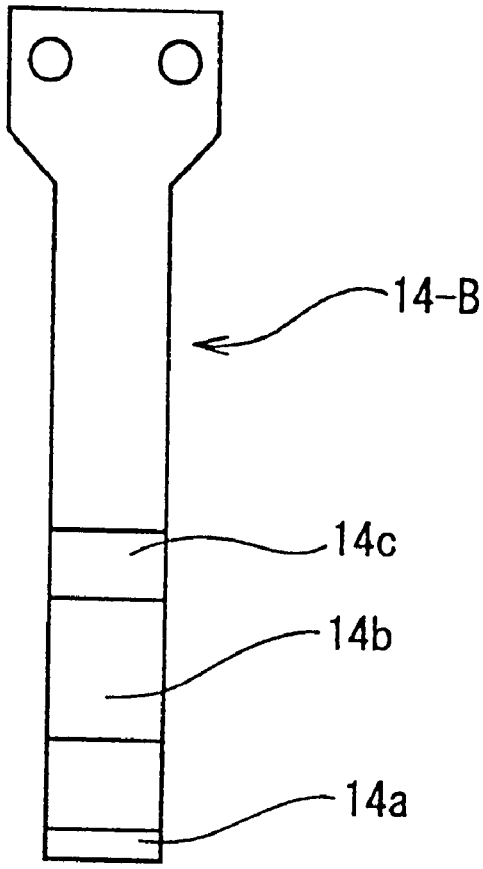
Figure 12:
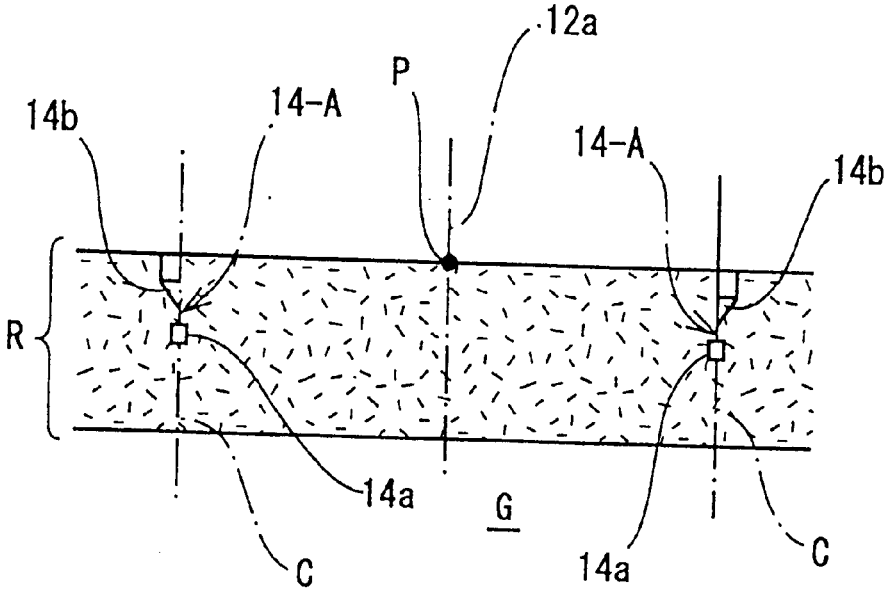
FIG. 12 is a cross-sectional view showing a state of cutting with the modified cutting blade.

FIGS. 11(A) and 11(B) show a modified cutting blade 14-B of the second embodiment. The modified cutting blade 14-B comprises an additional radially-protecting cutting face 14*d* in a stepped shape, on an upper portion of an inclined cutting face 14*b* so that the peripheral surface of the pavement to be cut in a frusto-conical shape is additionally cut in a stepped shape. FIG. 12 shows a state of cutting the pavement R by using said cutting blade 14-B.

Figure 13A:
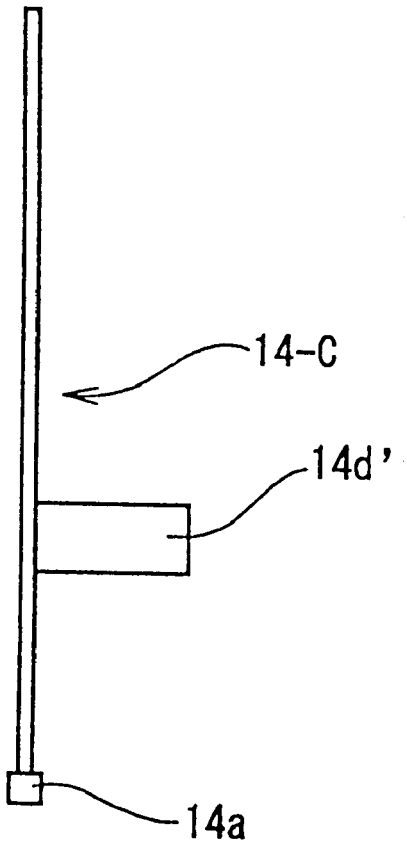
FIGS. 13(A) and 13(B) show a side view and a front view of a cutting blade of a third embodiment, respectively.
Figure 13B:
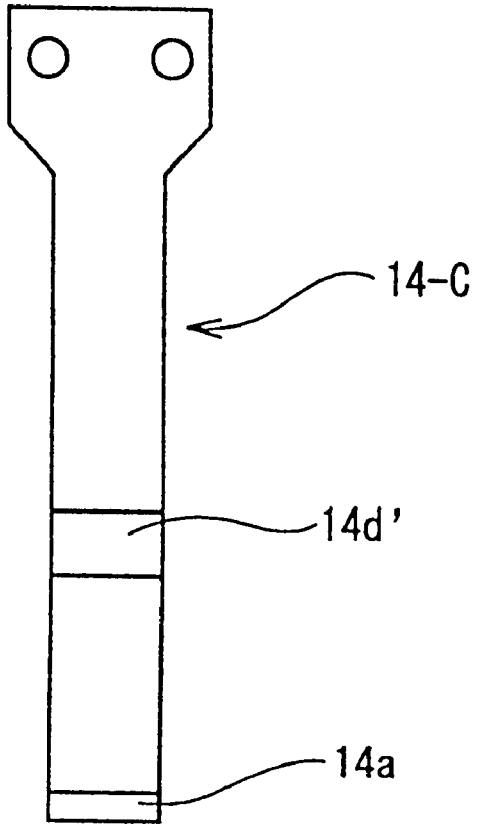

FIGS. 13(A) and 13(B) show a cutting blade 14-C of a third embodiment. The cutting blade 14-C comprises a cutting edge 14*a* for cutting the pavement and a radially-projecting stepped cutting edge 14*d*′. The cutting edge 14*a* is fixed to the bottom of the cutting blade 14-C and the cutting edge 14*d*′ is fixed to an upper portion of the cutting blade 14-C above the cutting edge 14*a*. Thus, a step is formed on the topside of the circular-cut section of the pavement R.

The cutting blade 14-C is positioned in a direction perpendicular to the pavement R to perform pavement cutting.

Figure 14:
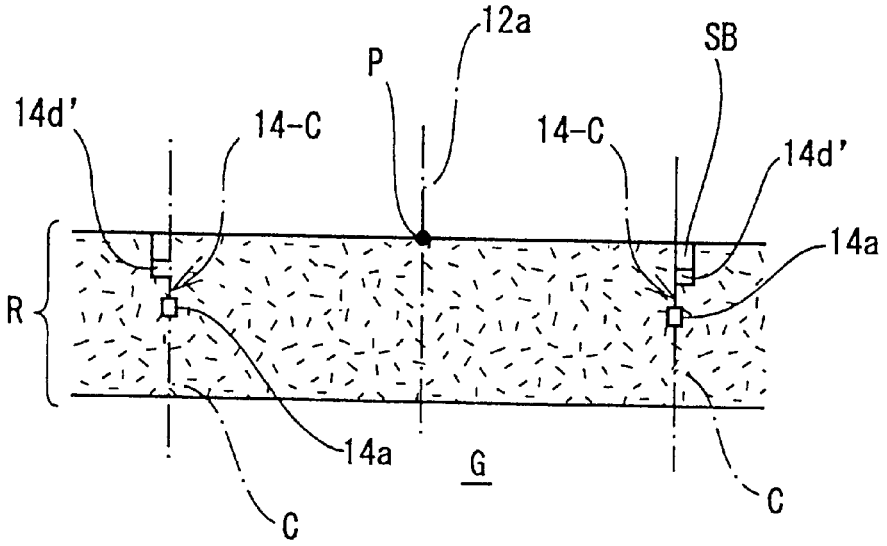
FIG. 14 is a cross-sectional view showing a state of cutting with the cutting blade of the third embodiment.
Figure 15:
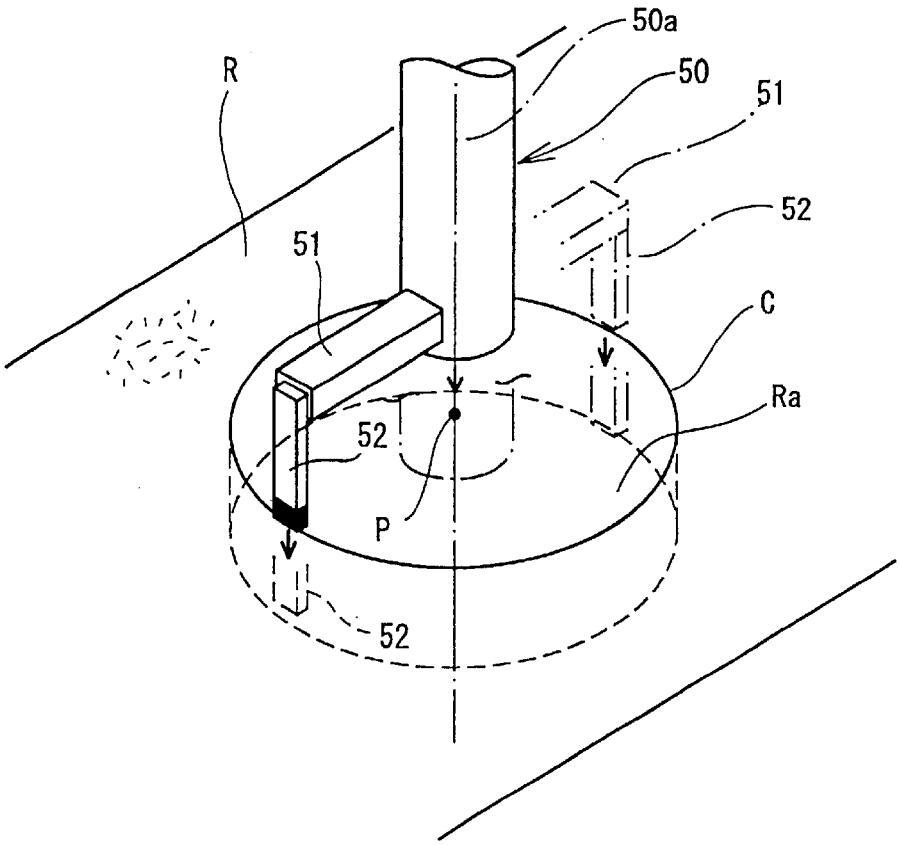
FIG. 15 is a perspective view of primary components of a conventional cutting apparatus.
Figure 16:
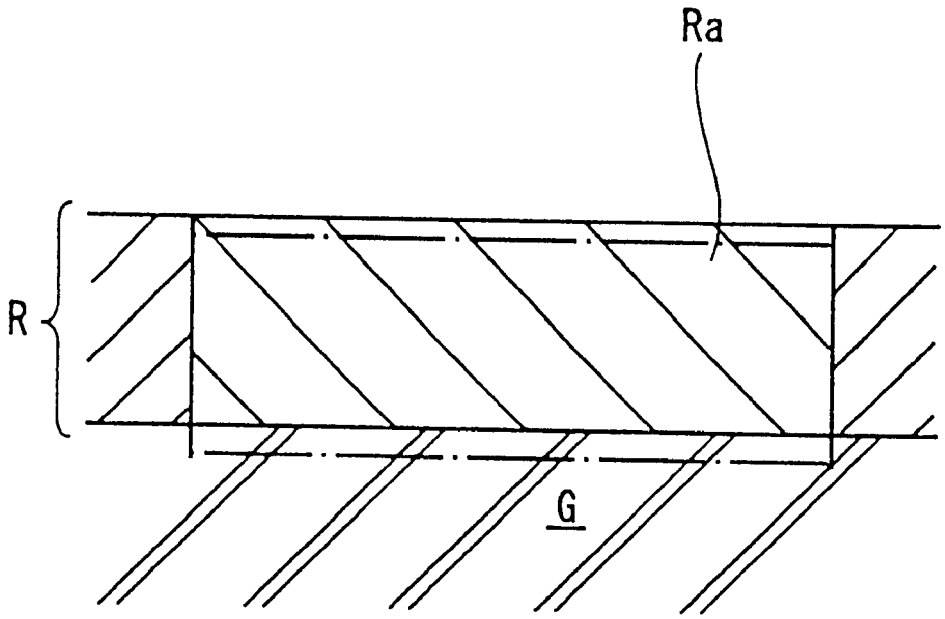
FIG. 16 is a cross-sectional view showing a state of pavement cut by use of the conventional apparatus.

In the case of cutting with the cutting blade 14-C, as shown in FIG. 14, the cutting blade 14-C moves forward while cutting away the peripheral face, so that a space SB corresponding to the stepped cutting edge 14*d*′ is formed around the circular-cut section of the pavement. As a result, even if the circular-cut section moves and falls to the ground, the circular-cut section of the pavement can be easily taken out of the pavement due to the space provided around the circular-cut section.

The number of arms projecting from below the main driving shaft 12 is not limited to one as in the first to third embodiments. For example, another arm having the same construction may be provided in the opposite direction, i.e. offset by 180°. Such a configuration reduces a cutting time.

Furthermore, in the cases of the first to third embodiments, the up-and-down movements drive means utilizes the handle 27 to be turned in order to vertically move the sleeve 25, but may use a prime mover such as an electric motor or the like instead of the handle 27.

As apparent from the foregoing description, according to the cutting blade of the present invention, the cutting blade travels along the circumference with rotation of the main driving shaft and, at the same time, the inclined cutting face of the cutting blade bores the inner peripheral surface of a circle to be cut, and thereby gradually reducing the diameter of the cut circle from top to bottom. The diameter of the lowermost cut-circle becomes shortest. Therefore, the circular-cut section of the pavement can move upward but cannot move downward because it is blocked by the non-cut section of the pavement, so that it is prevented from falling to the ground. As a result, the circular-cut section of the pavement can be easily taken out of the pavement.

Furthermore, when the pavement is cut by using the cutting blade with the stepped cutting edge, the step is formed on the periphery of the circular-cut section to support the circular-cut section, thereby preventing the cut-cut section from falling. Thus, the circular-cut section of the pavement can easily taken out of the pavement.

What is claimed is:

1. A cutting blade for cutting pavement in a circle, connected to an end of a radially-projecting arm attached to a driving shaft arranged vertically with respect to a center of the circle, and moved downwardly and simultaneously rotated along a circumference of the circle of the pavement to be cut, and a movement drive means makes the cutting blade go straight in a slanting inward direction, wherein a cutting blade body having a pavement cutting edge at a bottom thereof is inclined to the center of the circle to be cut, the pavement cutting edge serves as a tip for cutting the pavement and side edges of the cutting blade body serve as an inclined cutting surface to bore an inside of the pavement cut by the pavement cutting edge, thereby cutting the pavement in a frusto-conical shape.

2. The cutting blade according to claim 1, wherein the cutting blade body is flat in shape and attached to a holder in a slanting direction with respect to the pavement, and the holder is connected with the arm.

3. The cutting blade according claim 1, wherein the pavement cutting edge is a diamond tip.

4. A method for cutting pavement of an asphalt road or a concrete road in a circle for installation of a manhole, by using a cutting blade which has a pavement cutting edge which serves as a tip for cutting the pavement and side edges which serve as an inclined cutting surface to bore an inside of the pavement cut by the pavement cutting edge, thereby cutting the pavement in a frusto-conical shape, and a movement drive means is provided to make the cutting blade go straight in a slanting inward direction.

5. The method according claim 4, wherein said cutting blade is connected to an end of a radially-projecting arm attached to a driving shaft arranged vertically with respect to a center of the circle, and moved downwardly and simultaneously rotated along a circumference of the circle of the pavement to be cut, wherein the cutting blade is inclined to the center of the circle to be cut, and cuts the pavement in frusto-conical shape.

* * * * *